United States Patent [19]

Shibata et al.

[11] 4,159,626

[45] Jul. 3, 1979

[54] SECONDARY AIR CONTROL VALVE DEVICE

[75] Inventors: Norio Shibata; Tatsumi Furukubo, both of Susono, Japan

[73] Assignee: Toyota Jidosha Kogyo Kabushiki Kaisha, Aichi, Japan

[21] Appl. No.: 839,290

[22] Filed: Oct. 4, 1977

[30] Foreign Application Priority Data

Aug. 27, 1977 [JP] Japan ..... 52-102185

[51] Int. Cl.[2] ..... F01N 3/10

[52] U.S. Cl. ..... 60/276; 60/290

[58] Field of Search ..... 60/276, 289, 290; 137/862

[56] References Cited

U.S. PATENT DOCUMENTS

| | | | |
|---|---|---|---|
| 3,906,723 | 9/1975 | Matumoto | 60/290 |
| 3,931,710 | 1/1976 | Hartel | 60/276 |
| 4,112,678 | 9/1978 | Miyagi | 60/276 |

*Primary Examiner*—Douglas Hart

*Attorney, Agent, or Firm*—Stevens, Davis, Miller & Mosher

[57] ABSTRACT

Disclosed is a secondary air control device disposed in a system for supplying secondary air into an exhaust system of an internal combustion engine for purifying exhaust gas emitted from the engine. The secondary air control device comprises a first valve device actuated by an ON-OFF vacuum signal for stepwisely controlling the flow of secondary air in response to the ON-OFF vacuum signal, and; a second valve device, which is a delay system with a predetermined delay time, actuated by the ON-OFF vacuum signal for controlling the flow of secondary air. Accordingly, the secondary air control device can control the flow of secondary air, which comprises a step flow generated by the first valve device, and a delayed flow generated by the second valve device, in accordance with the ON-OFF vacuum signal.

10 Claims, 7 Drawing Figures

SECONDARY AIR CONTROL VALVE DEVICE

BRIEF DESCRIPTION OF THE INVENTION

This invention concerns a secondary air control device, especially a secondary air control device disposed in a system for supplying secondary air into an exhaust system of an internal combustion engine, which exhaust system is provided with a catalytic converter for purifying exhaust gas emitted from the engine, said secondary air control device being actuated by an ON-OFF vacuum signal for controlling the amount of said secondary air.

BACKGROUND OF THE INVENTION

Well-known in the art are engines which are provided with a catalytic converter, such as three way catalyzer, within the exhaust system thereof. In these engines secondary so as to purify harmful contaminants, such as carbon monoxide (CO), hydrocarbon (HC) and nitrogen oxides ($NO_x$), emitted from the engine. A sufficiently high temperature for causing the desirable activating reaction in the catalytic converter and an adequate air fuel ratio controlled so as to be maintained at the stoichiometric air fuel ratio are required for obtaining a high converting efficiency of the catalytic converter. (The term "secondary air fuel ratio" used hereinafter is defined as the total amount of air supplied to the engine, from the intake system to the exhaust system, to the amount of fuel.)

To maintain the secondary air fuel ratio at the stoichiometric air fuel ratio, a device for detecting the density of oxygen is disposed within the exhaust system at a position upstream of the catalytic converter, but downstream of the position where secondary air is supplied. A signal transmitted from the oxygen-detecting device is transferred to a computer which has an algebraic function therein for modulating the signal. The result obtained from the computer is utilized for stepwisely (ON-OFF) actuating a secondary air control valve device. As a result, secondary air is stepwisely supplied to the exhaust system of the engine.

The above-mentioned oxygen-detecting device can only detect whether the secondary air fuel ratio is on the lean side or the rich side of the stoichiometric air fuel ratio, and can not detect the variation of the secondary air fuel ratio from the stoichiometric air fuel ratio. Accordingly, when the secondary air is controlled stepwisely ON-OFF, in accordance with the signal transmitted from the oxygen-detecting device, the quantity of secondary air supplied may be more than or less than the amounts necessary to produce the stoichiometric air fuel ratio. As a result, the secondary air fuel ratio may be caused to fluctuate widely on both sides of the stoichiometric air fuel ratio. In addition, the operating characteristics of a carburetor and the secondary air control device may vary from the ideal characteristics due to different engine load conditions. This variation of the operating characteristics may increase the above-mentioned fluctuation of the secondary air fuel ratio.

To eliminate the above-mentioned problems, in some engines the secondary air flow flowing out of the secondary air control device has, when plotted on a graph with the amount of air as the ordinate and time as the abscissa, a special wave form, such as a triangular wave form, rather than a stepwise wave form. In these cases, the signal transmitted from the oxygen-detecting device is transferred to a computer having an algebraic function therein and the result obtained by the computer is utilized for actuating a plurality of actuating valve devices which are communicated with a vacuum source. Simultaneously, vacuum surge tanks, having small volumes and orifices, are utilized for transforming the wave form, obtained in a similar manner to that mentioned above, of the actuating vacuum transmitted from the actuating valves into a triangular wave form and for transmitting the triangular wave form actuating vacuum, to a single secondary air control device. The above-mentioned system, however, requires many complicated parts and connections for transforming the above mentioned wave form of the actuating vacuum signal of the secondary air control device into a triangular wave. Accordingly, the cost of the system is high, and the adjustment and maintenance of the system is troublesome. In addition, when the system is not adjusted or maintained properly, the reliability of the system can be lowered so that the required triangular wave form can not be obtained.

SUMMARY OF THE INVENTION

The principal object of the present invention is to provide a secondary air control device having a simple construction, which device can eliminate the above-mentioned problems and can easily control the secondary air fuel ratio so that it is maintained at the stoichiometric air fuel ratio.

The above-mentioned object of the present invention can be achieved by a secondary air control device comprising a first valve device actuated by an ON-OFF vacuum signal for stepwisely controlling the flow of secondary air in response to the ON-OFF vacuum signal, and; a second valve device, which is a delay system with a predetermined delay time, actuated by the ON-OFF vacuum signal for controlling the flow of secondary air. Accordingly, the secondary air control device according to the present invention can control the flow of secondary air which comprises a step flow generated by the first valve device and a delayed flow generated by the second valve device in accordance with the ON-OFF vacuum signal. As a result, the secondary air fuel ratio can be maintained close to the stoichiometric air fuel ratio. Further, the first valve device and the second valve device according to the present invention are only required to generate a step output of released secondary air proportional to an ON-OFF signal and a delayed output of released secondary air which is obtained when an ON-OFF signal is passed through a delay system. As a result, both the first valve device and the second valve device can be of simple construction, and be easy to adjust and maintain, so that the operation of the secondary air control valve device according to the present invention can be effected with high reliability and efficiency.

Another object of the present invention is to provide a secondary air control device provided with a second valve device, which second valve device includes a diaphragm chamber partitioned by a diaphragm and a throttling element disposed at a position between the diaphragm chamber and a transmitting device of the ON-OFF vacuum signal, so that the diaphragm chamber and the throttling element form a delay time element having a predetermined delay time.

A further object of the present invention is to provide a secondary air control device comprising a first valve device and a second valve device, wherein the first valve device and the second valve device are disposed in parallel to each other.

A still further object of the present invention is to provide a secondary air control device comprising a first valve device and a second valve device, wherein each of the first valve device and the second valve device further comprises a valve rod for connecting a valve to a diaphragm, and the two valve rods are coaxially disposed and the two diaphragms are integrated so that the secondary air control device can be compact in construction.

Other features and advantages of the present invention will be apparent from the detailed description of the invention set forth below, with reference to the accompanying drawings.

DETAILED DESCRIPTION OF THE INVENTION

Figure 1:
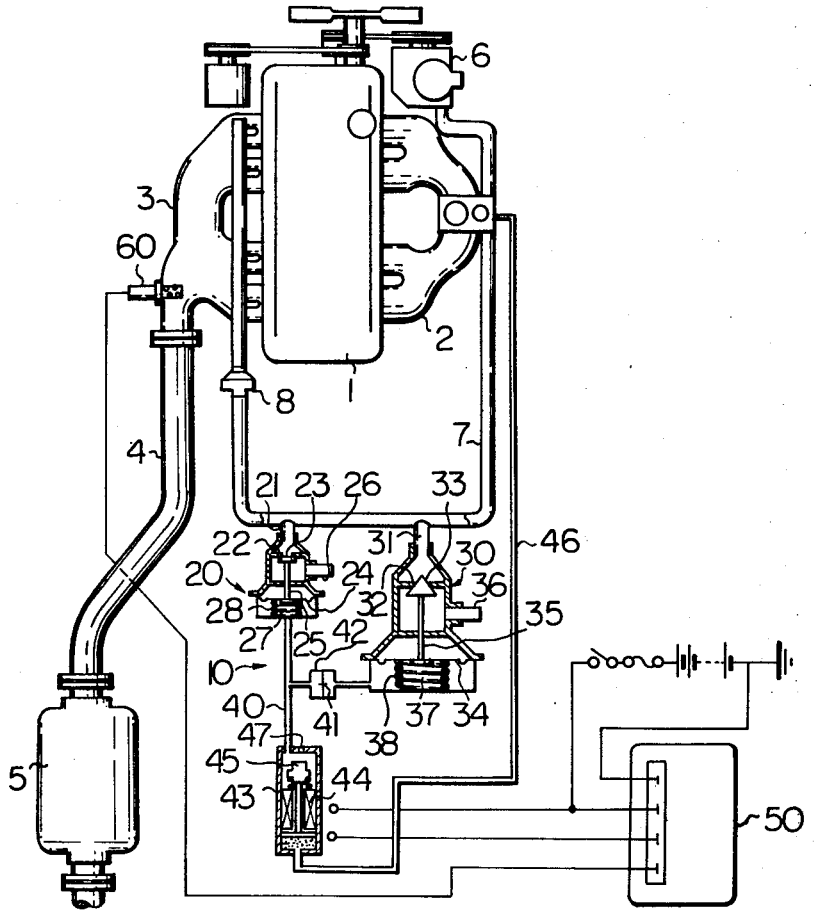
FIG. 1 is a plan view which schematically illustrates an engine with a secondary air control valve device according to the present invention.
Figure 2A:
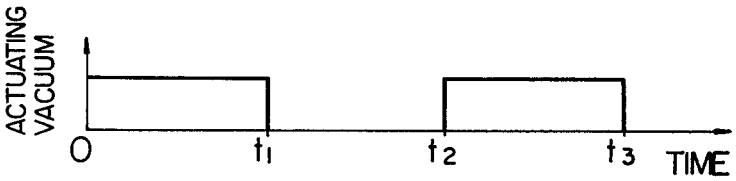
FIGS. 2 (*a*) to (*d*) are operational diagrams of the secondary air control valve device shown in FIG. 1, wherein FIG. 2 (*a*) illustrates the relationship between time and the actuating vacuum, FIG. 2 (*b*) illustrates the relationship between time and the secondary air flow released from the first valve device according to the present invention into the atmosphere, FIG. 2 (*c*) illustrates the relationship between time and the secondary air flow released from the second valve device according to the present invention into the atmosphere, and FIG. 2 (*d*) illustrates the relationship between time and the secondary air flow released from the secondary air control device mounted on the engine of FIG. 1 into the atomosphere.
Figure 2B:
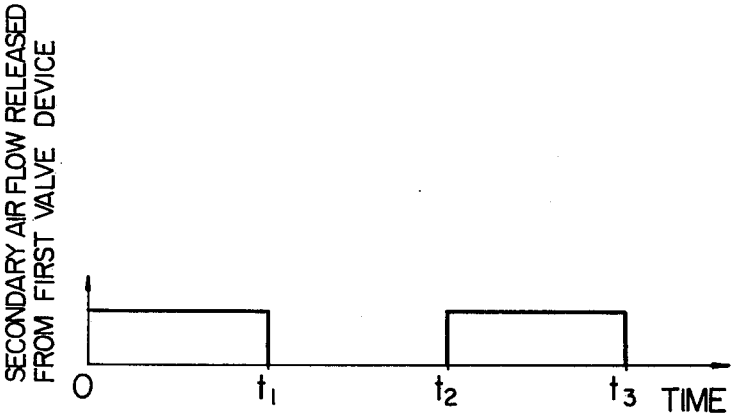
Figure 2C:
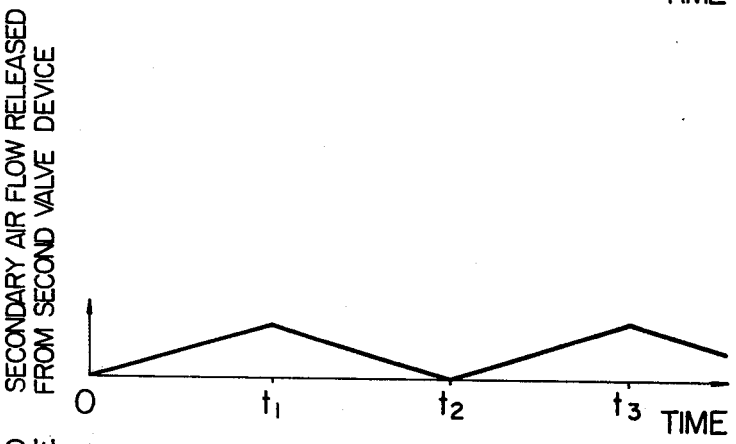
Figure 2D:
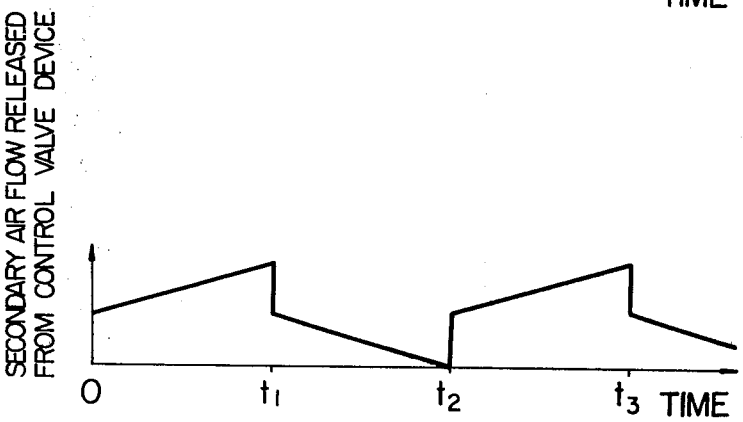

Embodiments according to the present invention are explained hereinafter with reference to the accompanying drawings. A four stroke-cycle engine 1 with four cylinders having a secondary air control valve device 10 mounted thereon is schematically illustrated in FIG. 1. The engine 1 is provided with an intake manifold 2 and an exhaust manifold 3. The exhaust manifold 3 is communicated with an auxiliary muffler 5 containing a three way catalyzer (not shown) and a main muffler (not shown) through a pipe 4. Secondary air supplied from an air pump 6, which is connected to the engine 1, is supplied to the exhaust manifold 3 through a secondary air pipe 7 containing a check valve 8 for preventing reverse flow from occurring. An inlet port 21 of a first valve device 20 and an inlet port 31 of a second valve device 30, of the secondary air control valve device 10 according to the present invention, are communicated with the secondary air pipe 7. Each of the above-mentioned first valve device and second valve device respectively comprises: a valve seat 22 or 32 opposite the inlet port 21 or 31; a valve 23 or 33 movable toward and away from the valve seat 22 or 32; a diaphragm 24 or 34; a valve rod 25 or 35 for connecting the valve 23 or 33 to the diaphragm 24 or 34; a by-pass port 26 or 36 for releasing secondary air introduced via the inlet port 21 or 31 and the valve seat 22 or 32 into the atmosphere, and; a diaphragm chamber 27 or 37 partitioned by the diaphragm 24 or 34 and containing a spring 28 or 38. The diaphragm chamber 27 of the first valve device 20 is directly communicated with a vacuum switching valve device 43 through a vacuum supply pipe 40. On the other hand, the diaphragm chamber 37 of the second valve device 30 is indirectly communicated with the vacuum switching valve device 43 via a throttling element 42 provided with an orifice 41 and the vacuum supply pipe 40.

The vacuum switching valve device 43 is communicated with the intake manifold 2 of the engine 1 through a vacuum pipe 46, and comprises: a solenoid 44; a valve 45 vertically movable by the solenoid 44, and; an air port 47 opened to the atmosphere. In accordance with a signal transmitted from a computer 50, the solenoid 44 is supplied with electric current and causes the vertical movement of the valve 45. As a result, the first valve device and the second valve device are supplied with an intake vacuum pressure or atmospheric pressure. The computer 50, having an algebraic function therein, receives a signal transmitted from a device 60 for detecting the density of oxygen and transmits a signal for actuating the solenoid 44 of the vacuum switching valve device.

The diaphragm chamber 37 of the second valve device 30 and the orifice 41 define a first order delay element.

The second valve device according to the present invention can also be a second or higher order delay system.

The operation of the secondary air control valve device 10, shown in FIG. 1, will now be explained with reference to FIG. 2.

The oxygen-detecting device 60 detects the density of oxygen and transmits a basic signal to the computer 50, which has an algebraic function therein. Utilizing the result obtained through the algebraic function, the computer 50 establishes whether the secondary air fuel ratio is on the lean side or the rich side of the stoichiometric air fuel ratio. When the secondary air fuel ratio is on the lean side, an electric current supply to the solenoid 44 of the vacuum switching valve device 43 is stopped. Then, a vacuum from the vacuum pipe 46 is supplied to the first valve device 20 and the second valve device 30 through the vacuum supply pipe 40 (at time 0). The first valve device 20 releases secondary air, introduced through the inlet port 21, into the atmosphere through the by-pass port 26 in response to the supplied vacuum (see FIG. 2 (*b*) at time 0 to $t_1$). On the other hand, the second valve device 30, which is a first order delay system with a predetermined first order delay time, releases secondary air, introduced through the inlet port 31, into the atmosphere through the by-pass port 36 with the passage of the time (see FIG. 2 (*c*) at time 0 to $t_1$). (The first order delay time is defined by the orifice 41 and the diaphragm chamber 37.) As a result, a part of the secondary air supplied through the secondary air pipe 7 is released from the secondary air control valve device 10 as shown in FIG. 2 (*d*), and the rest of the secondary air is supplied to the exhaust manifold 3 of the engine 1 (time 0 to $t_1$). As mentioned above, the amount of the secondary air supplied to the engine 1 is decreased with the passage of time.

When the computer 50 establishes that the secondary air fuel ratio detected by the oxygen-detecting device is on the rich side of the stoichiometric air fuel ratio, the computer 50 supplies an electric air current to the solenoid 44 of the vacuum switching valve device 43. As a result, a part of a secondary air flow comprising a step flow generated by the first valve device 20 and a delayed flow generated by the second valve device 30 is released from the secondary air control valve device 10 (see FIG. 2 (*d*), time $t_1$ to $t_2$), and the rest of the secondary air supplied through the secondary air pipe 7 is supplied to the exhaust manifold 3 of the engine 1.

Figure 3:
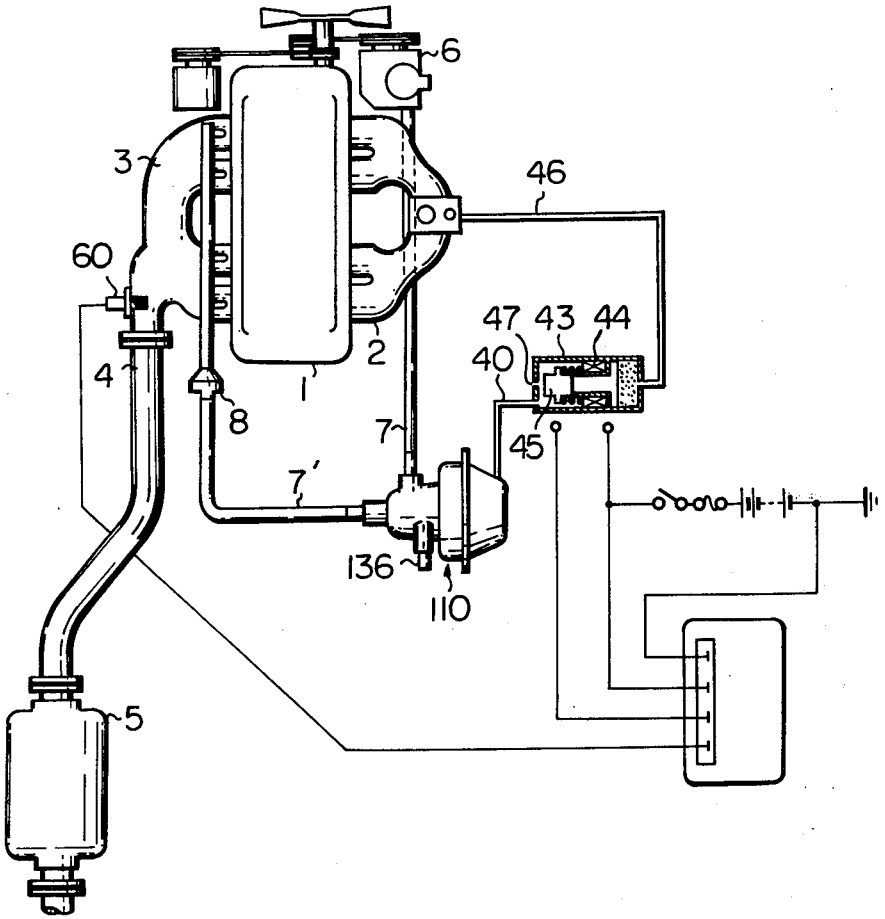
FIG. 3 is a plan view which schematically illustrates another engine with a secondary air control device according to the present invention.
Figure 4:
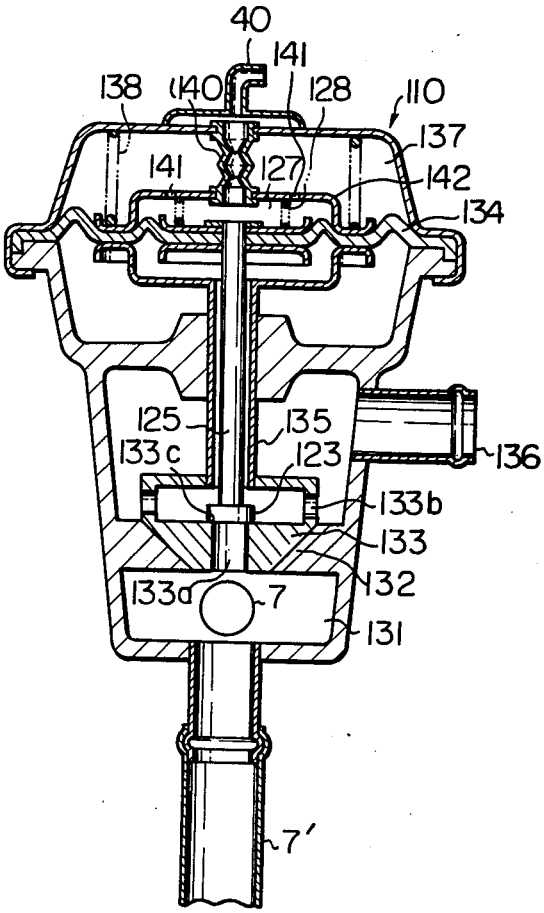
FIG. 4 is a cross-sectional view of the secondary air control valve device mounted on the engine shown in FIG. 3.

Another embodiment according to the present invention will now be explained with reference to FIGS. 3 and 4. An engine 1 illustrated in FIG. 3 is the same as the engine 1 illustrated in FIG. 1, except that a secondary air control valve device 110 is constructed in one body. Therefore, the same parts in FIG. 3 as in FIG. 1 are designated with the same reference numerals and their explanation is omitted. Referring to FIG. 4, the secondary air control valve device 110 shown in FIG. 3 will now be explained.

A secondary air pipe 7 communicated with an air pump 6 (FIG. 3) is communicated with a secondary air pipe 7' through an inlet port chamber 131. The secondary air pipe 7' is communicated with an exhaust manifold 3 (FIG. 3) via a check valve 8 (FIG. 3). The inlet port chamber 131 is communicated with a by-pass port 136 through a valve seat 132 having a conical shape. A valve 133 having a conical outer surface is movable toward and away from the valve seat 132. The valve 133 is connected to a diaphragm 134 via a hollow valve rod 135. The diaphragm 134 and the upper portion of the control valve device 110 form a diaphragm chamber 137. The diaphragm chamber 137 contains a spring 138 for urging the diaphragm 134 downward. The valve 133 having a conical outer surface is provided with a longitudinal hole 133*a* at the central portion thereof and communicates the inlet port chamber 131 with the by-pass port 136, through the longitudinal hole 133*a* and a hole 133*b* formed on the side wall of the valve 133. An upper surface of the valve 133 is provided with a horizontal valve seat 133*c* at an area surrounding the longitudinal hole 133*a*. A valve 123 is disposed so as to be movable toward and away from the valve seat 133*c*. The valve 123 is connected to a diaphragm via a valve rod 125, which rod is located within the hollow valve rod 135. The diaphragm 134 is provided with a partition 142 for covering the area where the valve rod 125 is connected so that an inner diaphragm chamber 127 is formed within the diaphragm chamber 137. The inner diaphragm chamber 127 has a spring 128 disposed therein for urging the diaphragm 134 downward. The partition 142 has one or more orifices 141 formed thereon for communicating the inner diaphragm chamber 127 with the diaphragm chamber 137. The partition 142 is also provided with a bellows 140 having a tube shape so as to communicate the diaphragm chamber 127 with a vacuum supply pipe 40 which is communicated with a vacuum switching device 43 (FIG. 3).

When vacuum is supplied through the vacuum supply pipe 40, the vacuum is introduced into the inner vacuum chamber 127 through the bellows 140. Then, the valve 123 is raised in response to the vacuum introduced into the inner diaphragm chamber 127. As a result, secondary air is released into the by-pass port 136 through the inlet port chamber 131. On the other hand, the vacuum is slowly introduced into the diaphragm chamber 137 from the inner diaphragm chamber 127 through the orifices 141. Then, the valve 133 is raised slowly as a result of the vacuum supplied from the inner diaphragm chamber 127, so that the secondary air is released into the by-pass port 136 through the valve seat 132.

When the vacuum supply through the vacuum supply pipe 40 is stopped and, at the same time, atmospheric pressure is supplied through the vacuum pipe 40, the inner diaphragm chamber 127 displaces the valve 123, so that it comes into contact with the valve seat 133*c*, in response to the change from vacuum pressure to atmospheric pressure. On the other hand, since the diaphragm chamber 137 is slowly supplied with atmospheric pressure from the inner diaphragm 127 through the orifices 141, the diaphragm 134, valve rod 135 and the valve 133 slowly move downward.

As will be apparent from the above description, the secondary air control valve device 110 shown in FIGS. 3 and 4 is compact.

The operation of the secondary air control device of the second embodiment according to the present invention is similar to the operation of the secondary air control device of the first embodiment according to the present invention, which operation is explained above with reference to FIGS. 2 (*a*) to (*d*).

What we claim is:

1. A secondary air control device disposed in a system for supplying secondary air into an exhaust system of an internal combustion engine, which exhaust system is provided with a catalytic converter for purifying exhaust gas emitted from said engine, said secondary air control device being actuated by an ON-OFF vacuum signal for controlling the amount of said secondary air supplied, wherein said secondary air control device is characterized by:

a first valve means actuated by said ON-OFF vacuum signal for stepwisely controlling the flow of secondary air in response to said ON-OFF vacuum signal, and;

a second valve means, which is a delay system with a predetermined delay time, actuated by said ON-OFF vacuum signal for controlling the flow of secondary air, whereby said secondary air control device can control the flow of secondary air, which comprises a step flow generated by said first valve means and a delayed flow generated by said second valve means, in accordance with said ON-OFF vacuum signal.

2. A secondary air control device according to claim 1, wherein each of said first valve means and said second valve means comprises a diaphragm capable of being operated by said ON-OFF vacuum signal and a valve connected to said diaphragm.

3. A secondary air control device according to claim 2, wherein said second valve means comprises a diaphragm chamber partitioned by said diaphragm and a throttling element disposed at a position between said diaphragm chamber and a means for transmitting said ON-OFF vacuum signal, said diaphragm chamber and said throttling element defining a delay element having said predetermined delay time.

4. A secondary air control device according to claim 2, which further comprises a secondary air supply means and a secondary air passage communicating said air supply means with said exhaust system of said engine, wherein said secondary air passage is communicated with said first valve means and said second valve means.

5. A secondary air control device according to claim 4, wherein said first valve means and said second valve means are disposed in parallel to each other at a position between said secondary air passage sand said transmitting means.

6. A secondary air control device according to claim 4, wherein each of said first valve means and said second valve means further comprises a valve rod for connecting said valve to said diaphragm, said pair of valve rods being disposed in parallel to each other and said pair of diaphragms being integrated with each other.

7. A secondary air control device according to claim 6, wherein one of said valve rods has a hole formed along the axis thereof and within said hole the other valve rod is coaxially and movably disposed.

8. A secondary air control device according to claim 6, wherein one of said diaphragm chambers is formed within the other diaphragm chamber.

9. A secondary air control device according to claim 6, wherein said valve rod of said second valve means has a hole formed along the axis thereof and said hole is connected to said diaphragm which forms said second diaphragm chamber, within said hole said valve rod of said first valve means is coaxially disposed so as to be movable along said axis and is connected to said first diaphragm which is formed in one body with said second diaphragm, and said secondary air control device further comprises a partition connected to said first diaphragm for forming said first diaphragm chamber within said second diaphragm chamber, said partition being provided with at least one hole thereon which forms said throttling element.

10. A secondary air control device according to claim 3, wherein said transmitting means is a vacuum switching valve means which is operated by a signal transmitted from a means for detecting the density of oxygen, which oxygen-detecting means is disposed at a position upstream of said catalytic converter in said exhaust system of said engine.

* * * * *